United States Patent [19]

Nilssen

[11] Patent Number: 5,032,765

[45] Date of Patent: Jul. 16, 1991

[54] OPERATING SYSTEM FOR FLUORESCENT LAMP ARRAY

[76] Inventor: Ole K. Nilssen, Caesar Dr., Rte. 5, Barrington, Ill. 60010

[21] Appl. No.: 394,313

[22] Filed: Aug. 14, 1989

Related U.S. Application Data

[63] Continuation of Ser. No. 740,860, Jun. 3, 1985, abandoned.

[51] Int. Cl.[5] ..... H05B 39/00

[52] U.S. Cl. ..... 315/97; 315/324; 315/360; 315/DIG. 4

[58] Field of Search ..... 315/94, 97, 312, 324, 315/360, 362, DIG. 4

[56] References Cited

U.S. PATENT DOCUMENTS

| | | | |
|---|---|---|---|
| 4,207,497 | 6/1980 | Capewell et al. | 315/DIG. 4 |
| 4,207,498 | 6/1980 | Spira et al. | 315/DIG. 4 |
| 4,259,618 | 3/1981 | Nilssen | 315/360 |
| 4,346,332 | 8/1982 | Walden | 315/DIG. 4 |
| 4,354,120 | 10/1982 | Schornack | 315/360 |
| 4,360,739 | 11/1982 | Goldstein | 315/360 |

*Primary Examiner*—Robert J. Pascal

[57] ABSTRACT

A lighting arrangement comprises:

a) an array of plural pairs of series-connected fluorescent lamps, with each lamp pair: i) adapted to be powered from 30 kHz/240 Volt by way of a high-Q series-resonant L-C circuit, ii) receiving cathode heating by way of transformer connected with the 30 kHz/240 Volt, iii) connected in parallel with the capacitor of the L-C circuits and iv) connected in parallel with a circuit protection means operative to limit the magnitude of the voltage that can develop across the capacitor of the L-C circuit as a result of Q-multiplication, and —in response to a control signal, or in case the lamp pair fails to start within a reasonably short time—to place a short circuit across the capacitor;

b) a frequency converter connected with a power line and operable to provide the 30 kHz/240 Volt; and c) programming means connected with each circuit protection means and operable: i) before providing 30 kHz/240 Volt to the array, to provide a signal to all circuit protection means, thereby placing a short circuit across each capacitor, ii) whenever it is desired that the array be activated to provide light, to remove the signal, but not until after a minimum period of about one second after the 30 kHz/240 Volt was applied, iii) whenever it is desired that the array should be deactivated, to re-provide the signal, and iv) to remove and/or re-provide the signal thereafter in accordance with any desired program.

16 Claims, 3 Drawing Sheets

OPERATING SYSTEM FOR FLUORESCENT LAMP ARRAY

This is a continuation of Ser. No. 740,860 filed June 3, 1985, abandoned.

BACKGROUND OF THE INVENTION

1. Field of Invention

The present invention relates to an electronic system for ballasting an array of fluorescent lamps.

2. Prior Art

Presently when ballasting a plurality of fluorescent lamps, such as in a sun tanning bed that typically comprises between 20 and 40 fluorescent lamps, with each lamp being 72" long and requiring about 100 Watt of power input for effective operation, these lamps are powered by way of a plurality of individual power-line-operated ballasts, with each ballast powering one or two lamps.

The fluorescent lamps most often used in these applications are of the so-called rapid-start type; which implies that each lamp requires four separate supply wires for proper operation. As a result, the number of wires required for powering 20-to-40 fluorescent lamps gets to be very high.

SUMMARY OF THE INVENTION

Brief Description

In its preferred embodiment, subject invention constitutes a lighting system comprising:

a) an array of plural pairs of series-connected fluorescent lamps, with each lamp pair: i) adapted to be powered from 30 kHz/240 Volt by way of a high-Q series-resonant L-C circuit, ii) receiving cathode heating by way of transformer connected with the 30 kHz/240 Volt, iii) connected in parallel with the capacitor of the L-C circuit, and iv) connected in parallel with a circuit protection means operative to limit the magnitude of the voltage that can develop across the capacitor of the L-C circuit as a result of Q-multiplication, and—in response to a control signal, or in case the lamp pair fails to start within a reasonably short time—to place an effective short circuit across the capacitor;

b) a frequency converter connected with a power line and operable to provide the 30 kHz/240 Volt; and c) programming means connected with each circuit protection means and operable: i) before providing 30 kHz/240 Volt to the array, to provide a signal to all circuit protection means, thereby placing an effective short circuit across each capacitor, ii) whenever it is desired that the array be activated to provide light, to remove the signal, but not until a minimum period of about one second after the 30 kHz/240 Volt was initially applied, iii) whenever it is desired that the array should be deactivated, to re-provide the signal, and iv) to remove and/or re-provide the signal thereafter in accordance with any desired program of activation and/or deactivation of the array.

DESCRIPTION OF THE PREFERRED EMBODIMENT

Details of Construction

Figure 1:
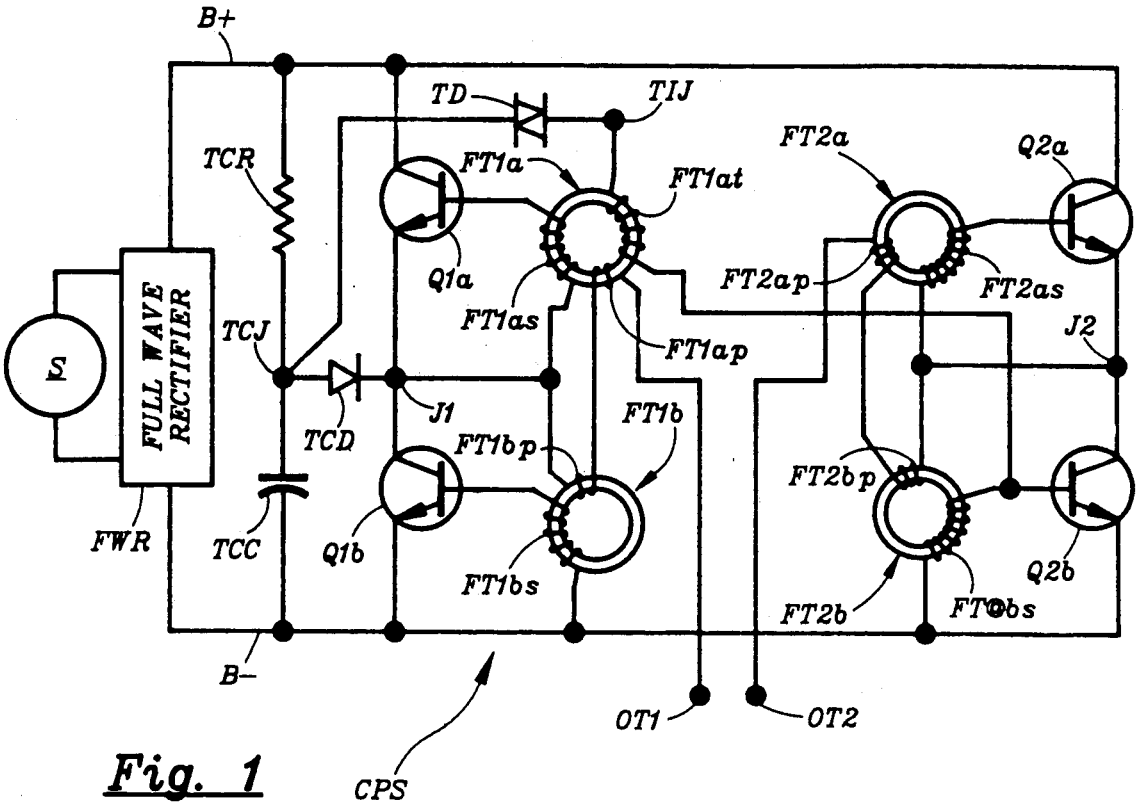
FIG. 1 provides a schematic illustration of the power-line-operated frequency-converting power supply.

FIG. 1 shows an AC voltage source S, which is a 240 Volt/60 Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and inverter output terminal OT1. Primary winding FT2*ap* of saturable feedback transformer FT2*a* and primary winding FT2*bp* of saturable feedback transformer FT2*b* are connected in series between junction J2 and inverter output terminal OT2.

Secondary winding FT1*as* of feedback transformer FT1*a* is connected between the base and the emitter of transistor Q1*a;* and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a;* and secondary winding FT2*bs* of feedback transformer FT2*b* is connected between the base and the emitter of transistor Q2*b*.

A tertiary winding FT1*at* of feedback transformer FT1*a* is connected between the base of transistor Q2*b* and a trigger input junction TIJ.

A trigger circuit resistor TCR is connected between the B+ bus and a trigger circuit junction TCJ; a trigger circuit capacitor TCC is connected between trigger circuit junction TCJ and the B− bus; and a trigger circuit diode TCD is connected with its anode to trigger circuit junction TCJ and with its cathode to junction J1. A trigger Diac TD is connected between trigger circuit junction TCJ and trigger input junction TIJ.

The overall power supply of FIG. 1 is referred to as central power supply CPS.

Figure 3:
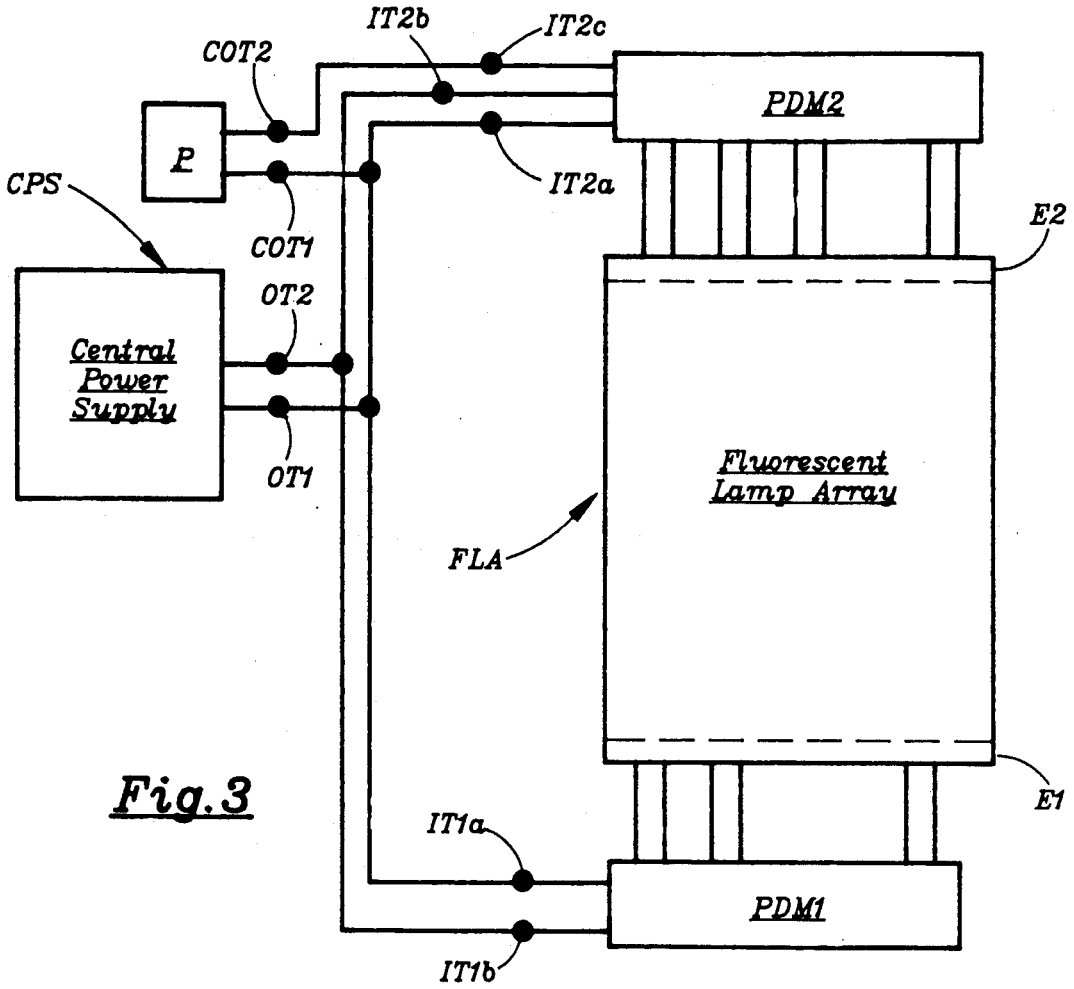
FIG. 3 diagrammatically describes the preferred embodiment of the overall lighting system.

FIG. 3 illustrates the preferred overall system for operating an array FLA of a plurality of fluorescent lamps.

Output terminals OT1 and OT2 of central power supply CPS are connected respectively with input terminals IT1*a* and IT1*b* of a power distribution means PDM1; which power distribution means is mounted next to one end E1 of fluorescent lamp array FLA.

Output terminals OT1 and OT2 are also connected respectively with input terminals IT2*a* and IT2*b* of a power distributing means PDM2; which power distributing means is mounted adjacent the other end E2 of fluorescent lamp array FLA.

Control signal output terminals COT1 and COT2 of a programmer P are connected respectively with input terminals IT2*a* and IT2*c* of power distributing means PDM2.

Figure 4:
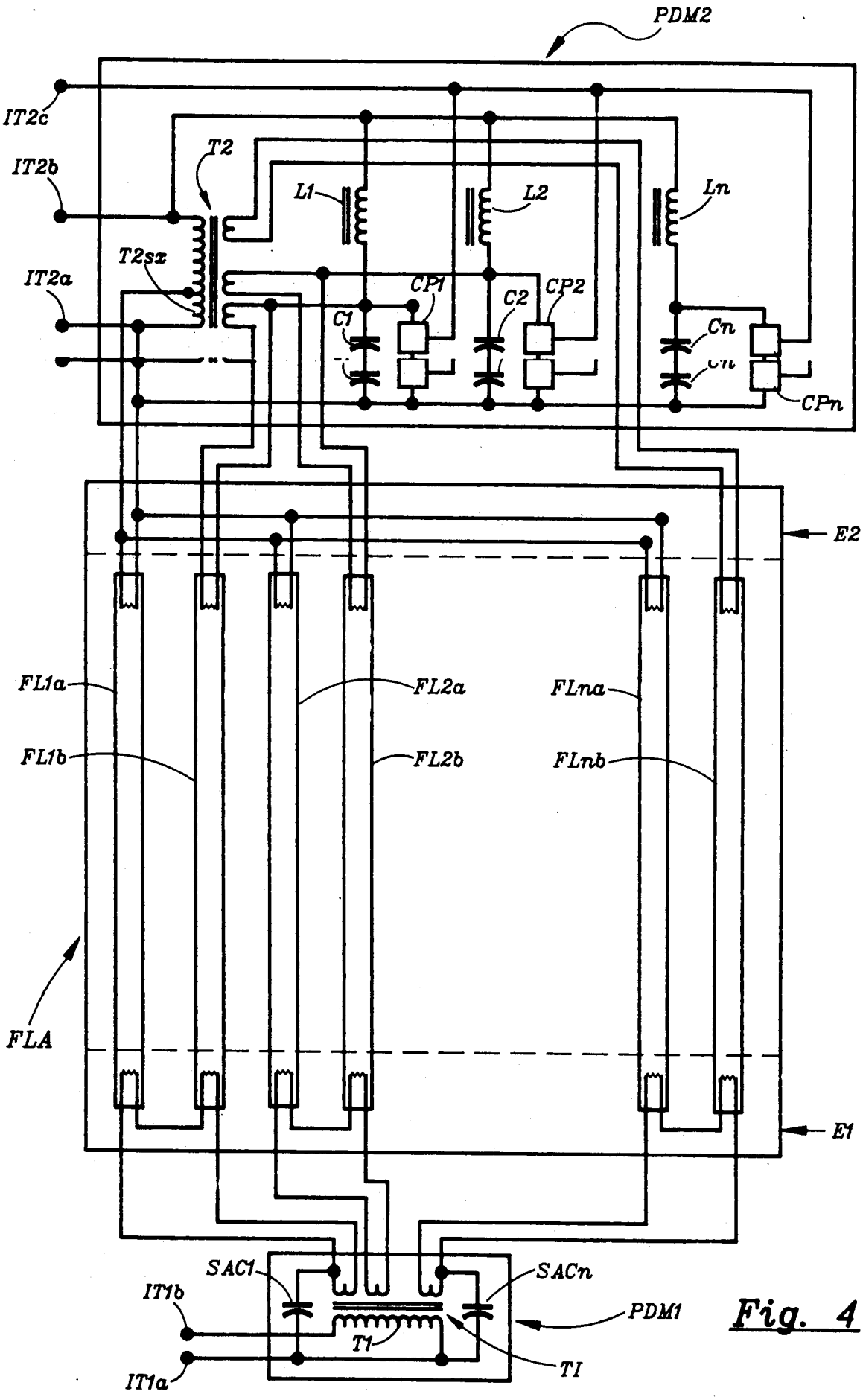
FIG. 4 provides details of the plural lamp pairs and associated ballasting and protection means.

As shown in FIG. 4, fluorescent lamp array FLA comprises a plurality of pairs of fluorescent lamps: FL1*a* & FL1*b*, FL2*a* & FL2*b* - - - FLna & FLnb.

Power distribution means PDM2 comprises a corresponding plurality of L-C ballasting means: L1 & C1, L2 & C2 - - - Ln & Cn; all of which are connected between input terminals IT2*a* and IT2*b*. Lamp pairs FL1*a*/FL1*b*, FL2*a*/FL2*b* - - - FLna/FLnb, by way of their upper cathodes (i.e., those cathodes located at or near end E2 of fluorescent lamp array FLA), are respectively connected across capacitors C1, C2 - - - Cn. Also connected across capacitors C1, C2 - - - Cn are circuit protectors CP1, CP2 - - - CPn, respectively.

Power distribution means PDM2 additionally comprises a transformer T2, which has its primary winding connected between input terminals IT2*a* and IT2*b*. This transformer has one special secondary winding T2*sx*, the output of which is connected with the parallel combination of all the upper cathodes of fluorescent lamps FL1*a*, FL2*a* - - - FLna. Transformer T2 also has a plurality of ordinary secondary windings, one connected with each of the upper cathodes of fluorescent lamps FL1*b*, FL2*b* - - - FLnb.

Power distribution means PDM1 comprises a transformer T1, which has its primary winding connected between input terminals IT1*a* and IT1*b*. This transformer has a plurality of secondary windings, with one such secondary winding being connected with the series-connection of the lower cathodes (i.e., the cathodes located at or near end E1 of fluorescent lamp array FLA) of each fluorescent lamp pair FL1*a*/FL1*b*, FL2*a*/FL2*b* - - - FLna/FLnb. Starting aid capacitors SACl and SACn are connected from input terminal IT1*a* to the lower cathodes of lamps FL1*a* and FLnb, respectively. A starting aid capacitor is similarly connected with the lower cathode of lamp FL2*a* as well, but is not shown.

Figure 5:
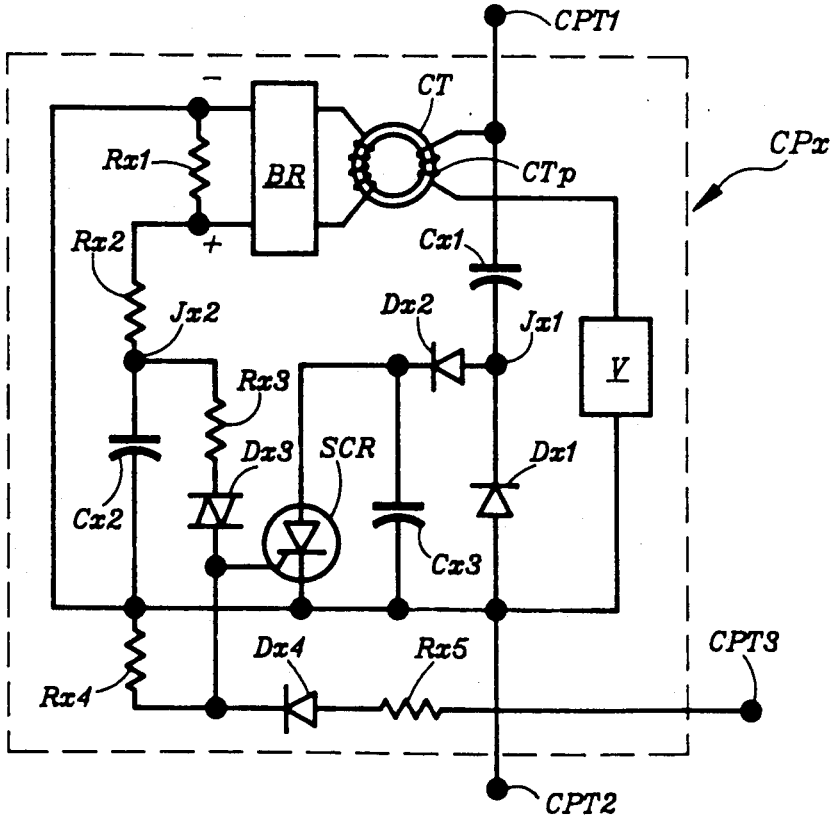
FIG. 5 provides schematic details of the circuit-protection means.

FIG. 5 provides details of a circuit protector CPx; which circuit protector is like those identified in FIG. 4 as CP1, CP2 - - - CPn. This circuit protector has three terminals CPT1, CPT2 and CPT3.

Primary winding CTp of a current transformer CT is connected in series with a Varistor V to form a series-combination, and this series-combination is connected between terminals CPT1 and CPT2. A diode Dx1 is connected with its anode to terminal CPT2 and with its cathode to a junction Jx1. A capacitor Cx1 is connected between junction Jx1 and terminal CPT1. Another diode Dx2 is connected with its anode to junction Jx1 and with its cathode to the anode of a thyristor SCR. The cathode of thyristor SCR is connected with terminal CPT2.

The secondary winding of transformer CT is connected with a bridge rectifier BR, the negative output terminal of which is connected with the cathode of thyristor SCR. A resistor Rx1 is connected across the output terminals of rectifier BR. A resistor Rx2 is connected between the positive output terminal of rectifier BR and a junction Jx2; and a capacitor Cx2 is connected between junction Jx2 and the SCR cathode.

A resistor Rx3 and a Diac Dx3 is connected in series between junction Jx2 and the gate of thyristor SCR; and a resistor Rx4 is connected between the gate and the cathode of thyristor SCR.

A resistor Rx5 and a diode Dx4 is connected in series between the SCR gate and terminal CPT3, with the cathode of Dx4 being connected with the SCR gate.

Within power distribution means PDM2, circuit protector CPx is connected in such manner that terminals CPT2 and CPT3 of CPx are connected with input terminals IT2*a* and IT2*c* of PDM2, respectively. Terminal CPT1 is connected with the junction between the capacitor and the inductor of the associated L-C series-combination.

Details of Operation

The operation of the central power supply CPS of FIG. 1 may be explained as follows.

FIG. 1 shows a full bridge inverter connected with the unfiltered DC voltage output of full wave rectifier FWR. This DC voltage has a waveform as indicated in FIG. 2(*a*); which, with the power line voltage being 240 Volt/60 Hz, effectively consists of sinusoidally-shaped unidirectional voltage pulses of 120 Hz frequency and approximately 340 Volt peak magnitude.

The inverter is of a type that needs to be triggered into oscillation. Triggering is accomplished by way of the trigger circuit consisting of resistor TCR, capacitor TCC, diode TCD and Diac TD, and is arranged and phased such as momentarily to place transistors Q1*a* and Q2*b* into states of conduction, thereby initiating positive feedback by way of feedback transformers FT1*a* and FT2*b*. As indicated in FIG. 2(*b*), this trigger circuit provides for a single trigger pulse at the beginning of each of the 120 Hz voltage pulses. Multiple trigger pulses are avoided by diode TCD, which acts to place an effective short circuit across capacitor TCC once inverter oscillation starts.

With a load present across output terminals OT1 and OT2, the inverter will initiate oscillation at the beginning of each DC voltage pulse, and will cease oscillation at the end of each DC voltage pulse. The inverter's output will be a squarewave voltage as illustrated in FIG. 2(*c*). This squarewave voltage is of 30 kHz fundamental frequency and is amplitude modulated at a 120 Hz rate.

Figure 2:
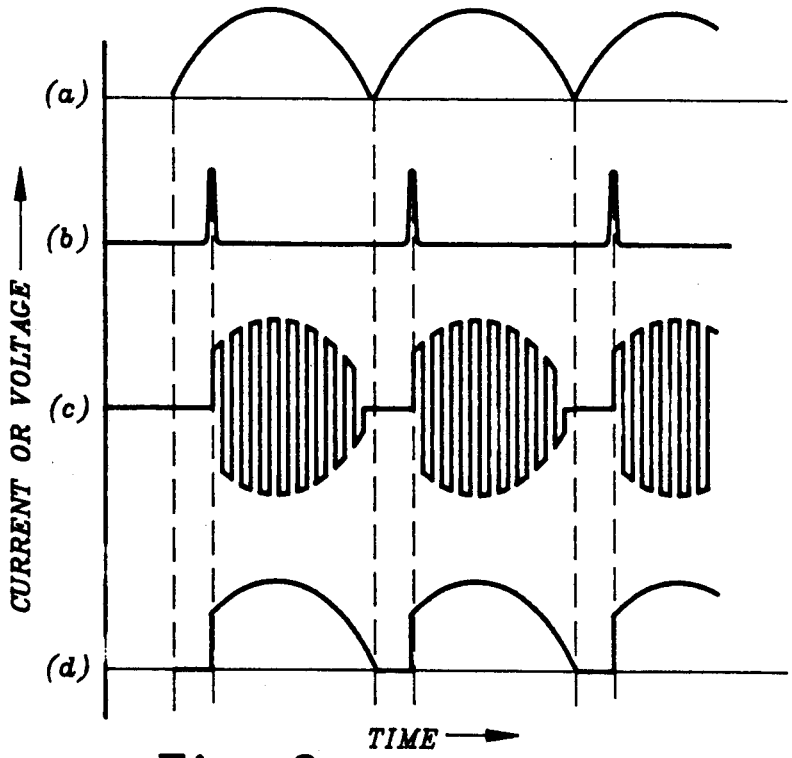
FIG. 2 illustrates various voltage and current waveforms associated with the power supply of FIG. 1.

With the inverter's load being substantially resistive, the current drawn by the inverter from the DC power supply will be as indicated by FIG. 2(*d*).

For additional explanations relating to the operation of this type of inverter, reference is made to U.S. Pat. Nos. 4,184,128, 4,502,107 and 4,506,318, all issued to Nilssen.

As indicated by FIGS. 3 and 4, the 30 kHz amplitude modulated squarewave output from the inverter is applied across each of a number n of L-C series-circuits. Each of these L-C series-circuits has a relatively large unloaded Q-factor and is resonant at or near 30 kHz, and therefore gives rise to so-called Q-multiplication. Thus, without any load applied to the L-C circuit, and assuming linear operation, the magnitude of the voltage developing across the L and the C will be larger than that of the voltage applied across the L-C series-circuit by a factor of Q, where Q is the quality-factor of the L-C circuit.

With an unloaded Q-factor of 100, which is quite readily attainable with cost-effective components, and with the magnitude of the 30 kHz voltage provided by the inverter being about 240 Volt RMS, the magnitude of the voltage developing across the capacitor of the L-C circuit would be on the order of 24,000 Volt RMS—assuming linearity.

However, the circuit components would indeed not remain linear if subjected to such voltage magnitudes; and it is necessary to provide some form of over-voltage protection for each L-C circuit so as to prevent such large-magnitude voltages from developing—otherwise destruction of circuit components would result.

Such over-voltage protection is provided for each L-C series-circuit in the form of a pair of series-connected fluorescent lamps; which lamps, when operated in the rapid-start mode, requires about 400 Volt RMS for proper starting and about 250 Volt RMS for proper operation. Thus, such a pair of lamps does indeed provide over-voltage protection for the L-C series-circuit, but only as long as the lamps are connected and operative.

However, since a lamp may indeed be disconnected or inoperative, it is necessary to provide for alternative means of over-voltage protection. Such alternative over-voltage protection is provided by circuit protectors—such as CPx of FIG. 5—with one circuit protector connected in parallel with each capacitor of each L-C series-circuit.

Since the voltage drop across the primary winding of current transformer CT within each voltage protector is essentially negligible in comparison with the required over-voltage limiting level, the Varistor comprised within each of these circuit protectors is effectively connected across the capacitor of its associated L-C circuit and acts to limit the magnitude of the voltage developed thereacross to about 400 Volt RMS—regardless of the state and/or presence of the fluorescent lamps.

However, although this Varistor is indeed capable of absorbing the approximately 300 Watt of power provided to it when doing over-voltage limiting, it can only do so for a brief period of time—such as for 100 milliseconds or so. Its long term dissipation is limited to about 1 Watt.

To protect the Varistor, as well as to minimize wasted energy, the circuit protector of FIG. 5 is so arranged that an effective short circuit is placed across the Varistor after current has flowed through the primary of current transformer CT for about 100 milliseconds. This short circuit is principally caused by thyristor SCR, which is triggered into its conductive state by way of Diac Dx3 after the voltage on capacitor Cx2 has increased to a level high enough to cause the Diac to break down.

The value of capacitor Cx1 is chosen such that its impedance at 30 kHz is very low, whereby—as long as thyristor SCR is indeed conducting—its presence across the Varistor represents an effective short circuit.

The values of resistors Rx1 and Rx2 are chosen such that it takes about 100 milli-second for capacitor Cx2 to charge to a voltage of magnitude sufficient to cause Diac Dx3 to break down.

The values of capacitor Cx2 and resistor Rx3 are chosen such that—once Diac Dx breaks down—current will be flowing into the gate of thyristor SCR for a period of about 30 seconds, thereby keeping the effective short circuit present across the associated capacitor in effect for about 30 seconds after each time current has flowed through the Varistor for more than about 100 milli-seconds.

In other words, the Varistor operates to limit the magnitude of the voltage developing across its associated capacitor to a level just right for proper lamp starting. Once the lamps have started, the magnitude of the voltage across the associated capacitor will fall to the level associated with normal lamp operation, which is about 250 Volt RMS. After that has occurred, current ceases to flow through the Varistor.

In addition to being activatable by current flowing through the primary winding of current tramsformer CT for a period of about 100 milli-seconds, the thyristor is also activatable by a positive voltage provided at terminal CPT3 with respect to terminal CPT2; which implies that by providing a voltage from the output of programmer P—with COT2 being positive in respect to COT1—all the circuit protectors in power distribution means PDM2 can be activated, thereby providing effective short circuits across each of all the lamp pairs of fluorescent lamp array FLA.

With the lamp cathodes hot, 400 Volt RMS is adequate to start the pair of series-connected fluorescent lamps. With cold lamp cathodes, however, 400 Volt RMS is inadequate to start the lamps. Therefore, on initial application of power to the fluorescent lamp array, since it takes from 1.0 to 1.5 second for the cathodes to reach incandescence, and since the circuit protectors activate in about 100 milli-seconds, the circuit protectors activate before the lamps get started, thereby preventing lamp starting for a period of about 30 seconds.

After this 30 second period, during one of the zero-voltage intervals between the pulses or bursts of 30 kHz squarewave voltage applied to the L-C series-circuits (see FIG. 2*c*), the thyristor in each circuit protector would cease being conductive, thereby removing the protective short circuit. By then the cathodes would have become hot and the lamps would therefore have started within a few milli-seconds when exposed to the 400 Volt RMS. Thus, if initial application of power to the fluorescent lamp array were to be done without providing any kind of pre-conditioning to the lamp cathodes, the lamps would not start until after about 30 seconds.

However, by way of programmer P, the overall system is adapted to operate in such a way as to provide heating power to the lamp cathodes for at least 1.5 second before applying the 400 Volt RMS voltage to start the lamps. That is, upon initially applying power to the overall system, the programmer immediately provides a positive voltage at its output, thereby causing each individual circuit protector to assume its short circuit mode. The programmer then removes this positive voltage some time after at least 1.5 second, at which point the lamp cathodes have become incandescent and are ready to start within a few milli-seconds after being exposed to 400 Volt RMS.

The programmer then keeps the positive voltage removed until it is time to turn off the light output from the whole array of fluorescent lamps. When that time comes, the positive voltage is re-applied; which then provides for continuous provision of cathode heating power, but removes main lamp operating power.

Thus, the programmer can be used as a timer or program control of the overall lighting system of FIG. 3, turning main power on and/or off in accordance with any desired pre-programmed pattern, providing cathode heating power in advance of providing lamp operating power, etc.

With small modifications, it would readily be possible to have the programmer control the activation of the inverter itself by providing a signal from a separate programmer output to the inverter's trigger circuit junction TCJ.

Additional Comments a) With a dissipation of 330 Watt for 100 milli-seconds each 30 seconds, the Varistor dissipates an average power of about 1.1 Watt; which is within the allowed average dissipation rate on many common low-cost Varistors. However, by shortening the ON-time from 100 to 50 milli-seconds, which would provide for totally adequate starting time for most types of fluorescent lamps, the average dissipation would be reduced to only 0.55 Watt. The amount of energy required to be absorbed by the Varistor would be 33 Joule during the 100 milli-second interval and 16.5 Joule during the 50 milli-second interval; both of which values are commonplace for many common low-cost Varistors.

b) The L-C ballasting arrangement used herein, as illustrated in FIG. 4, may be considered as an L-C resonant circuit that is series-excited by a voltage source and parallel-loaded by a fluorescent lamp. As long as the unloaded circuit-Q is substantially higher than the loaded circuit-Q, such a circuit arrangement may accurately be considered as a means of converting a constant voltage source to a constant current source—where the output current provided is substantially independent of the load, but is rather determined by the magnitude of the voltage provided to the L-C series-combination. In other words, for a given magnitude of input voltage, the output current will be constant—substantially regardless of the nature of the load.

c) To make lamp starting easier, lamp starting capacitors have been provided, as indicated by SACl and SACn of FIG. 4.

d) Main lamp operating power can be controlled by controlling the phasing of the trigger point of FIG. 2(*b*).

e) Due to the effect of the high-Q L-C series-resonant ballasting means herein used, as described in b) above, the power factor associated with the current drawn from the power line by the power supply of FIG. 1 will be very high.

f) If one of the lamps in the overall fluorescent lamp array is inoperative (or removed), all lamp pairs will operate normally except for the lamp pair to which the inoperative lamp belongs.

g) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a power supply connected with an ordinary electric utility power line and operative to provide an AC voltage at an output; the AC voltage being of a frequency different from that of the voltage provided by said ordinary electric utility power line;

an assembly of fluorescent lamps, each lamp requiring cathode heating power as well as current-limited lamp starting and operating voltage, said assembly having: i) transformer means connected with said output and operable to provide said cathode heating power, and ii) ballasting means connected with said output and operable in response to a control signal to provide and/or not to provide said current-limited lamp starting and operating voltage; the AC voltage being substantially non-affected by the action of the control signal; and programming means connected with said ballasting means and operative to provide said control signal, thereby to control the provision and non-provision of said lamp starting and operating voltage.

2. The arrangement of claim 1 wherein the power supply comprises frequency conversion means and wherein the frequency of said AC voltage is substantially higher than that of the voltage on said power line.

3. The arrangement of claim 1 wherein said ballasting means comprises an L-C circuit effectively connected across said output, and wherein this L-C circuit is resonant at or near the frequency of said AC voltage.

4. The arrangement of claim 1 wherein said programming means is operative to cause said lamp starting and operating voltage to be provided only after said cathode heating power has been provided for at least a brief period of time.

5. The arrangement of claim 4 wherein said brief period of time is on the order of one second.

6. The arrangement of claim 1 wherein said AC voltage consists of periodic pulses of relatively high frequency voltage and wherein these periodic pulses are separated by periods where the instantaneous magnitude of said AC voltage is substantially zero, the frequency of said periodic pulses being substantially lower than that of said high frequency voltage.

7. The arrangement comprising:

a power supply connected with an ordinary electric utility power line and operative to provide an AC voltage at an output; the frequency of the AC voltage being substantially higher than that of the voltage provided from said ordinary electric utility power line;

an assembly of plural fluorescent lamp means, each lamp means requiring current-limited lamp starting and operating voltage, said assembly having ballasting means connected with said output and operable in response to a control signal to provide and/or not to provide for each lamp means said current-limited lamp starting and operating voltage; and programming means connected with said ballasting means and operative to provide said control signal, thereby to control the provision and non-provision to said lamp means of said lamp starting and operating voltage while said AC voltage is being continuously supplied.

8. The arrangement of claim 7 wherein said AC voltage consists of periodic pulses of a relatively high frequency voltage and wherein the repetition rate of said periodic pulses is relatively low as compared with the frequency of said relatively high frequency voltage.

9. The arrangement of claim 7 wherein said ballasting means comprises an L-C series-circuit effectively connected across said output, and wherein this L-C series-circuit is resonant at or near the fundamental frequency of said AC voltage.

10. The arrangement comprising:

a gas discharge lamp having a starting voltage and an operating voltage, the starting voltage being of substantially larger magnitude than the operating voltage;

a current source connected with this lamp and conditionally operative to provide said starting voltage and operating voltage; and shorting means connected in parallel circuit with the lamp and operative, in response to a control signal provided at a control input, to provide and/or not to provide an effective short circuit across the lamp; such that, when said effective short circuit is indeed being provided, the magnitude of any voltage present across the gas discharge lamp is prevented from reaching a magnitude as high as that of the starting voltage;

whereby the provision of said starting and operating voltage may be controlled by way of said control signal.

11. The arrangement of claim 10 and programmer means connected with said control input, said programmer means being programmably operable to provide said control signal in accordance with a desired pre-programmed time-pattern.

12. The arrangement of claim 10 wherein the shorting means comprises voltage-limiting means operative to prevent the magnitude of the voltage developing across the lamp from substantially exceeding that of said starting voltage.

13. An arrangement comprising:

a gas discharge lamp having a starting voltage and an operating voltage, the starting voltage being of substantially larger magnitude than the operating voltage;

a current source operative to connect with this lamp and, when so connected, to conditionally provide said starting voltage and operating voltage; and protection means connected in parallel circuit with the lamp and operative: i) to prevent the magnitude of the voltage developing across the lamp from substantially exceeding that of said starting voltage, even if the lamp were to be inoperative, and ii) in response to a control signal provided at a control input, to provide and/or not to provide an effective short circuit across the lamp; such that, when said effective short circuit is indeed being provided, the magnitude of any voltage present across the lamp is prevented from reaching a magnitude as high as that of the starting voltage;

whereby the provision and/or non-provision of said starting voltage and operating voltage may be controlled by a control signal provided at said control input.

14. An arrangement comprising:

a source of AC voltage;

a series-combination of an inductor and a capacitor effectively connected across said AC voltage, said series-combination being series-resonant at or near the frequency of said AC voltage;

means operative to permit connection of a gas discharge lamp effectively in parallel with said capacitor, this lamp: i) having a starting voltage and an operating voltage, the starting voltage being of magnitude substantially larger than that of the operating voltage, and ii) when functioning and connected with the capacitor, being operative to limit the magnitude of the voltage developing thereacross to a safe level; and protection means effectively connected in parallel with the capacitor and, if the lamp is non-functioning or non-connected thereto, operative: i) to limit the magnitude of the voltage developing thereacross to a safe level, and ii) in response to a control signal provided at a control input, to apply for any desired period of time a short circuit thereacross; the duration of said desired period of time being adjustable by way of an adjustment means;

whereby the provision or non-provision of said starting voltage and operating voltage may be controlled by corresponding provision of said control signal at said control input.

15. An arrangement comprising:

rectifier means connected with an ordinary electric utility power line and operative to provide a DC voltage at a DC output;

inverter connected with said DC output and operative to provide a substantially non-current-limited AC voltage at an output;

fluorescent lighting means connected with said AC output and conditionally operable to provide light output, said lighting means having control means operable in response to a control signal, to provide and/or not to provide said light output;

such that the lighting means can be turned ON and OFF in response to said control signal even though the AC voltage is still being provided to the fluorescent lighting means.

16. The arrangement of claim 15 wherein said power line provides a 60 Hz voltage and wherein said DC voltage is non-filtered and effectively comprised of 120 Hz unidirectional voltage pulses.

* * * * *